United States Patent [19]

Neuwirth

[11] Patent Number: 4,743,212

[45] Date of Patent: May 10, 1988

[54] TELEPHONE CONNECTOR BLOCK WITH CORROSION CREEP INHIBITING MEANS

[75] Inventor: Helmuth Neuwirth, Garden City, N.Y.

[73] Assignee: Dorta Systems Corp., Syosset, N.Y.

[21] Appl. No.: 577,029

[22] Filed: Feb. 6, 1984

[51] Int. Cl.[4] ..... H01R 9/24

[52] U.S. Cl. ..... 439/722; 439/719

[58] Field of Search ..... 339/198 R, 198 G, 198 GA, 339/198 H, 198 J, 198 E

[56] References Cited

U.S. PATENT DOCUMENTS 3,154,364 10/1964 Gerg ..... 339/198 H 3,263,129 7/1966 Glassman ..... 339/198 GA

FOREIGN PATENT DOCUMENTS 0353976 11/1937 Italy ..... 339/198 E

*Primary Examiner*—Gil Weidenfeld

*Assistant Examiner*—Thomas M. Kline

*Attorney, Agent, or Firm*—Charles E. Temko

[57] ABSTRACT

An improved quick clip type connecter block for telephone use in which exposed metallic terminals are mounted upon discrete supporting structure each separated from adjacent structure by a substantial air gap to inhibit the formation of short circuits by increasing the effective length of the path over which progressively growing corrosed materials must travel to establish a conductive path between adjacent terminals.

2 Claims, 1 Drawing Sheet

TELEPHONE CONNECTOR BLOCK WITH CORROSION CREEP INHIBITING MEANS

BACKGROUND OF THE INVENTION

This invention relates generally to the field of telephony, and more particularly to an improved quick clip connecter block of known type in which provision has been made for the prevention of electrical shorting between adjacent quick clip connecters occasioned by the growth of conductive oxidized materials surrounding the quick clip terminals.

The use of quick clip terminals for telephone use has grown at a geometric rate in recent years. Connecters of this type are relatively inexpensive to manufacture, and usually incorporate insulation displacement means. Their use reduces the number of traditional wire wrapping operations which are necessary in the installation of a connecter block.

One disadvantage in the use of quick clip connecters is that the clips are formed from metallic materials which are subject to corrosion, particularly when placed in an ambient atmosphere of high moisture content. The metallic material, usually steel, or a non-ferrous alloy combines with oxygen to form a flake-like corrosive material, the outer periphery of which creeps away from the surface of the terminal. In known constructions, the creep is often sufficient, with passage of time, to reach an adjacent quick clip terminal on the block to form an electrical short between adjacent terminals. It is, of course, not economically feasible to plate the quick clip terminals with a noble metal, and it is also undesirable to space the terminals apart any further than is necessary to permit installation of a related conductor.

SUMMARY OF THE INVENTION

Briefly stated, the invention contemplates the provision of an improved quick clip connecter block of the type described in which provision has been made for substantially reducing, if not eliminating, the problem of short circuits occurring by reason of the growth of corroded materials surrounding the base of the individual quick clip terminals. To this end, each terminal is supported upon an insulative stud formed integrally with the base of the block, each stud being separated from adjoining studs by a planar air gap over which the corrosive material must flow to reach an adjacent quick clip terminal. The gap is sufficiently wide to prevent the bridging thereof by the corroded material.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
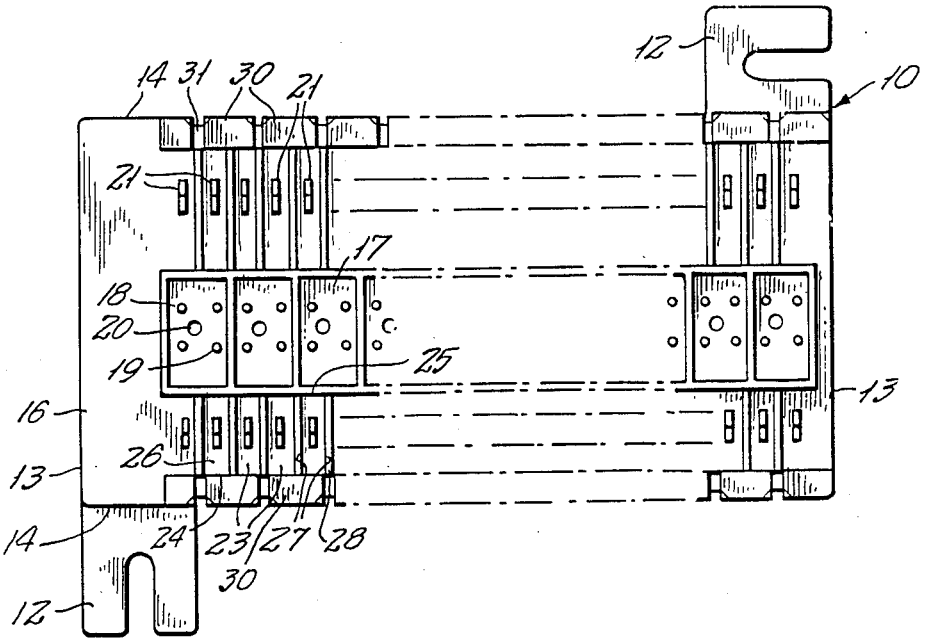
FIG. 1 is a top plan view of the embodiment of the invention.
Figure 2:
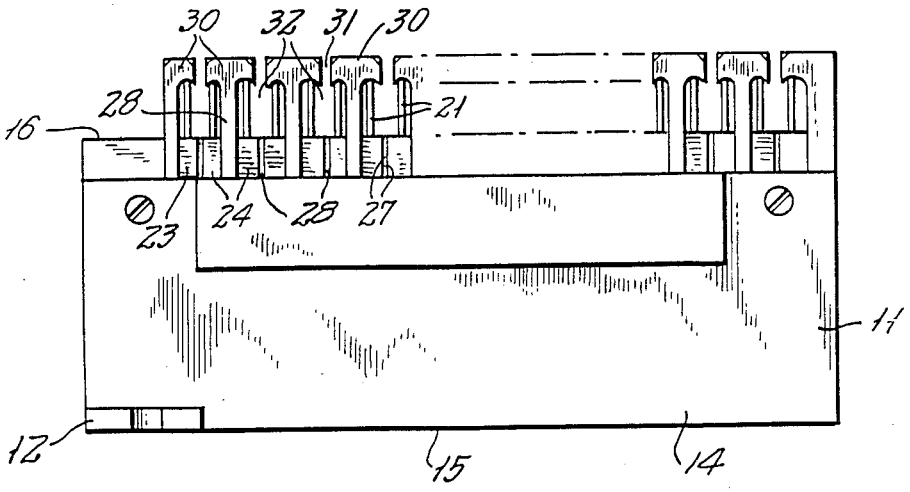
FIG. 2 is a side elevational view thereof.

In accordance with the invention, the device, generally indicated by reference character 10, comprises a molded base element 11 of insulative material, preferably incorporating attachment lugs 12 to permit mounting upon a suitable fixture. In the configuration disclosed in the drawing, the device may be installed in a mounting designated as Western Electric type 66, but it will be understood by those skilled in the art, that other types of mounting known in the art are also suitable.

The base element is bounded by end surfaces 13, side surfaces 14, a bottom surface 15, and an upper surface 16. Centrally disposed socket-forming surfaces 17 surround tip 18 and ring pins 19 and a grounding socket 20 for each of a plurality of known protector modules (not shown) through which circuits entering and leaving the block pass. The pins 18 and 19 communicate with respective quick clip connecters 21 having wire wrap inner terminals (not shown). Each connecter 21 is preferably insert molded within an elongated mounting stud 23, the studs 23 being arranged in rows parallel to the surfaces 17. Each stud is bounded by an outer surface 24, an inner edge 25, an upper surface 26, and side surfaces 27. The side surfaces 27 are spaced apart from each other to form a generally planar gap or groove 28 between each of the studs 23.

Adjacent the outer edge surfaces 24 are a plurality of wire guide members 30 of known type, each forming a narrow entry 31 leading to an enclosed space 32 through which conductors engaged upon the connecters 21 pass in known manner.

Following installation, with passage of time, owing to the fact that the quick clip connecters are formed of material which is not corrosion free, the surfaces will corrode. In prior art devices, the flake-like material, as it grows in volume, tends to expand its periphery until it reaches an adjacent terminal, effecting a short. In the present construction, because the gaps 28 between the studs 23 are sufficiently wide as to prevent the bridging by the corroded material, the periphery must first extend over the side surfaces 27 first toward the upper surface 16, and then away from it, before it can reach the adjacent terminal. The effective travel path is therefore increased many fold, and it will normally be sufficient to prevent formation of short circuits throughout the useful life of the device.

I wish it to be understood that I do not consider the invention limited to the precise details of structure shown and set forth in this specification, for obvious modifications will occur to those skilled in the art to which the invention pertains.

I claim:

1. In a quick clip type telephone connector block, including a base element and at least one row of juxtaposed quick clip connectors for the interconnection of wire conductors forming parts of individual subscriber circuits, the improvement comprising: a pair of parallel mounting studs of rectangular cross-section integrally mounted upon the surface of said base element and extending laterally therefrom, a single quick clip connector being partially enclosed within each of said mounting studs such that the free operative ends of said connectors project outwardly therefrom for the engagement of a related conductor; said mounting studs being spaced apart from each other to form a gap therebetween of the order of at least 0.050 inches in width; whereby, upon the formation of corrosion upon adjacent quick clip terminals due to exposure to the ambient atmosphere, the path of creep corrosed material must travel over the surface of adjacent studs forming said gap before reaching an adjacent terminal.

2. The improvement in accordance with claim 1, in which said quick clip connectors are insert molded within the said studs.

* * * * *